US008739502B2

(12) United States Patent
Lancaster, III

(10) Patent No.: US 8,739,502 B2
(45) Date of Patent: Jun. 3, 2014

(54) METHODS AND APPARATUS FOR EVALUATING PACKAGING MATERIALS AND DETERMINING WRAP SETTINGS FOR WRAPPING MACHINES

(75) Inventor: Patrick R. Lancaster, III, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 357 days.

(21) Appl. No.: 13/283,996

(22) Filed: Oct. 28, 2011

(65) Prior Publication Data

US 2012/0102886 A1 May 3, 2012

Related U.S. Application Data

(60) Provisional application No. 61/408,540, filed on Oct. 29, 2010.

(51) Int. Cl.

| | |
|---|---|
| ***B65B 53/00*** | (2006.01) |
| ***G01N 3/08*** | (2006.01) |
| ***B65B 13/02*** | (2006.01) |

(52) U.S. Cl.

USPC ..... 53/441; 53/399; 73/830; 73/826

(58) Field of Classification Search

USPC ..... 73/788, 830, 826, 862.381, 862.391; 53/399, 441

See application file for complete search history.

(56) References Cited

U.S. PATENT DOCUMENTS

| | | | |
|---|---|---|---|
| 5,765,344 | A | 6/1998 | Mandeville et al. |
| 7,779,607 | B2 | 8/2010 | Lancaster, III et al. |
| 2008/0295614 | A1 | 12/2008 | Lancaster, III et al. |

FOREIGN PATENT DOCUMENTS

| | | | |
|---|---|---|---|
| EP | 0 671 324 | A1 | 9/1995 |

OTHER PUBLICATIONS

European Patent Office; Search Report and Written Opinion in International Patent Application No. PCT/US2011/058304 dated Jul. 12, 2012; 14 pages.

European Patent Office; Search Report/Invitation to Pay Additional Fees in International Patent Application No. PCT/US2011/058304 dated May 9, 2012; 4 pages.

*Primary Examiner* — Lisa Caputo
*Assistant Examiner* — Jonathan Dunlap
(74) *Attorney, Agent, or Firm* — Wood, Herron & Evans, LLP

(57) ABSTRACT

A method of determining a wrap force or payout percentage at which to wrap a load with packaging material may include dispensing packaging material. The method may also include forming a tear in a portion of the packaging material. The method may further include identifying a first payout percentage at which the tear exhibits a first behavior. The method may also include identifying a second payout percentage at which the tear exhibits a second behavior. The method may further include selecting a third payout percentage between the first payout percentage and the second payout percentage, for wrapping the load.

28 Claims, 10 Drawing Sheets

| FILM | GAUGE | TEST DATE | FIRST PAYOUT PERCENTAGE | SECOND PAYOUT PERCENTAGE | THIRD PAYOUT PERCENTAGE | CONTAINMENT FORCE AT 105% | CONTAINMENT FORCE AT 105% | SECOND INTERMEDIATE PAYOUT PERCENTAGE | FIRST INTERMEDIATE PAYOUT PERCENTAGE | FIRST CONTAINMENT FORCE | FIRST WRAP FORCE |
|---|---|---|---|---|---|---|---|---|---|---|---|
| 34 | 36 | 37 | 38 | 36 | 40 | 42 | 43 | 62 | 60 | 44 | 46 |
| | | | | | | | | | | | |

100

32

FIG. 8A

| SECOND CONTAINMENT FORCE | SECOND WRAP FORCE | FIRST WEIGHT | FIRST WEIGHT PER REVOLUTION | SECOND WEIGHT | SECOND WEIGHT PER REVOLUTION | THIRD CONTAINMENT FORCE | THIRD WRAP FORCE | FOURTH CONTAINMENT FORCE | FOURTH WRAP FORCE |
|---|---|---|---|---|---|---|---|---|---|
| 52 | 54 | 48 | 50 | 56 | 58 | 64 | 66 | 72 | 74 |
| | | | | | | | | | |

100

32

FIG. 8B

| THIRD WEIGHT | THIRD WEIGHT PER REVOLUTION | FOURTH WEIGHT | FOURTH WEIGHT PER REVOLUTION | FIRST ESTIMATED NO. OF REVOLUTIONS | FIRST ESTIMATED WEIGHT | SECOND ESTIMATED NO. OF REVOLUTIONS | SECOND ESTIMATED WEIGHT | THIRD ESTIMATED NO. OF REVOLUTIONS | THIRD ESTIMATED WEIGHT |
|---|---|---|---|---|---|---|---|---|---|
| 68 | 70 | 76 | 78 | 84 | 86 | 88 | 90 | 92 | 94 |
| | | | | | | | | | |

100

32

FIG. 8C

| FOURTH ESTIMATED NO. OF REVOLUTIONS | FOURTH ESTIMATED WEIGHT | CUSTOMER LOAD HEIGHT | DESIRED CONTAINMENT FORCE | TOTAL CONTAINMENT FORCE | CUSTOMER ESTIMATED NO. OF REVOLUTIONS | CUSTOMER ESTIMATED WEIGHT | CUSTOMER ESTIMATED NO. OF REVOLUTIONS | CUSTOMER ESTIMATED WEIGHT |
|---|---|---|---|---|---|---|---|---|
| 96 | 98 | 82 | 80 | 81 | 126 | 128 | 130 | 132 |
| | | | | | | | | |

100

32

FIG. 8D

METHODS AND APPARATUS FOR EVALUATING PACKAGING MATERIALS AND DETERMINING WRAP SETTINGS FOR WRAPPING MACHINES

CROSS-REFERENCE TO RELATED APPLICATIONS

This application claims the filing benefit of U.S. Provisional Patent Application Ser. No. 61/408,540 filed on Oct. 29, 2010, which is incorporated by reference herein in its entirety.

TECHNICAL FIELD

The present disclosure relates to methods and apparatus for wrapping loads, and more particularly, for evaluating packaging materials used to wrap loads and to help machine operators set up wrapping machines.

BACKGROUND

Wrapping machine operators understand the importance of providing an adequate containment force on the vertical sides of their loads using packaging material, and doing so at a minimum cost. Achieving this can be difficult. Major suppliers of packaging material often times offer several types of packaging materials for sale. Moreover, each type of packaging material may be offered in multiple gauges. Thus, wrapping machine operators need to evaluate and select from many alternative types and gauges of packaging material. Furthermore, there are a large number of combinations of containment force, packaging material gauge, and packaging material types that may potentially provide an adequate containment force, making evaluating the packaging materials an even more complex task.

In order to understand how to provide an adequate containment force on the vertical sides of their loads at a minimum cost, wrapping machine operators look for ways to identify and understand the characteristics of a range of packaging materials that impact load holding effectiveness and cost. Typically, evaluating individual packaging materials is done on actual production wrapping machines. The process entails experimenting with packaging materials in an attempt to identify or predict wrapping machine settings at which the packaging materials being tested exert an adequate containment force on the load, with an acceptable number of packaging material breaks during wrapping. Determining an adequate containment force includes performing shipping tests on wrapped loads, and using a containment force tool to measure those wrapped loads that passed the shipping tests while remaining intact, and thus, are held with an adequate containment force.

Then by cutting off the layers of packaging material from the load and weighing them, the weight of the packaging material providing the adequate containment force can be found. This approach for evaluating packaging materials is problematic due to the number of variables involved, and because a large sample size is typically required. The cost, time, and risk of the above-described approach discourages most companies from evaluating packaging materials, including new and possibly more effective formulations, to avoid having to test them and/or having to recalibrate their wrapping machines.

The present disclosure is directed to overcoming one or more of the above-noted problems, and/or other problems in the art.

SUMMARY

According to an aspect of the present disclosure, a method of determining a wrap force at which to wrap a load with packaging material may include dispensing packaging material. When a wrapping machine is configured to selectively meter packaging material to a load, then the wrap force is related to the payout percentage at which the material is dispensed to the load. The method may also include forming a tear in a portion of the packaging material. The method may further include identifying a first payout percentage at which the tear exhibits a first behavior. The method may also include identifying a second payout percentage at which the tear exhibits a second behavior. The method may further include selecting a third payout percentage between the first payout percentage and the second payout percentage, for wrapping the load.

According to another aspect of the present disclosure, a method of determining a number of relative revolutions between a packaging material dispenser and a load for wrapping the load may include wrapping a test load with packaging material at a selected payout percentage. The method may also include determining a wrap force exerted by each wrap of packaging material on the test load. The method may further include determining a partial containment force for a wrapped load at a selected area of the wrapped load. The method may also include obtaining one or more characteristics of the load. The method may further include obtaining one or more characteristics of the packaging material. The method may also include determining a total containment force for wrapping the load based on the partial containment force, the one or more characteristics of the load, and the one or more characteristics of the packaging material. The method may further include determining the number of relative revolutions for wrapping the load based on the total containment force and the wrap force exerted by each wrap of packaging material on the test load.

According to another aspect of the present disclosure, an apparatus may include a packaging material dispenser configured to dispense packaging material for wrapping a load. The apparatus may also include a relative rotation assembly configured to provide relative rotation between the packaging material dispenser and the load. The apparatus may further include a selectively extendable wrap hazard configured to damage the packaging material.

Additional objects and advantages of the present disclosure will be set forth in part in the description which follows, and in part will be obvious from the description, or may be learned by practice of the present disclosure. The objects and advantages of the present disclosure will be realized and attained by means of the elements and combinations particularly pointed out in the appended claims.

It is to be understood that both the foregoing general description and the following detailed description are exemplary and explanatory only and are not restrictive of the present disclosure, as claimed.

The accompanying drawings, which are incorporated in and constitute a part of this specification, illustrate embodiments of the present disclosure and together with the description, serve to explain the principles of the present disclosure.

BRIEF DESCRIPTION OF THE DRAWINGS

FIGS. 8A-8D depict portions of a spreadsheet, table, or chart, according to an aspect of the present disclosure.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts. The disclosures of each of U.S. Patent Application Publication No. 2007/0204565, entitled "METHOD AND APPARATUS FOR METERED PRE-STRETCH FILM DELIVERY," filed Feb. 23, 2007; U.S. Patent Application Publication No. 2007/0209324, entitled "METHOD AND APPARATUS FOR SECURING A LOAD TO A PALLET WITH A ROPED FILM WEB," filed Feb. 23, 2007; U.S. Patent Application Publication No. 2009/0178374, entitled "ELECTRONIC CONTROL OF METERED FILM DISPENSING IN A WRAPPING APPARATUS," filed Jan. 7, 2009; U.S. Pat. No. 7,568,327, entitled "METHOD AND APPARATUS FOR SECURING A LOAD TO A PALLET WITH A ROPED FILM WEB," filed Jan. 30, 2004; U.S. Pat. No. 7,707,901, entitled "APPARATUS AND METHOD FOR MEASURING CONTAINMENT FORCE IN A WRAPPED LOAD AND A CONTROL PROCESS FOR ESTABLISHING AND MAINTAINING A PREDETERMINED CONTAINMENT FORCE PROFILE," filed Apr. 21, 2008; and U.S. Pat. No. 7,779,607, entitled "WRAPPING APPARATUS INCLUDING METERED PRE-STRETCH FILM DELIVERY ASSEMBLY," filed Feb. 23, 2007, are all incorporated herein by reference in their entirety. Examples and descriptions of the disclosure are also set forth in the disclosure materials that are included as part of this application and are incorporated herein by reference.

Figure 1:
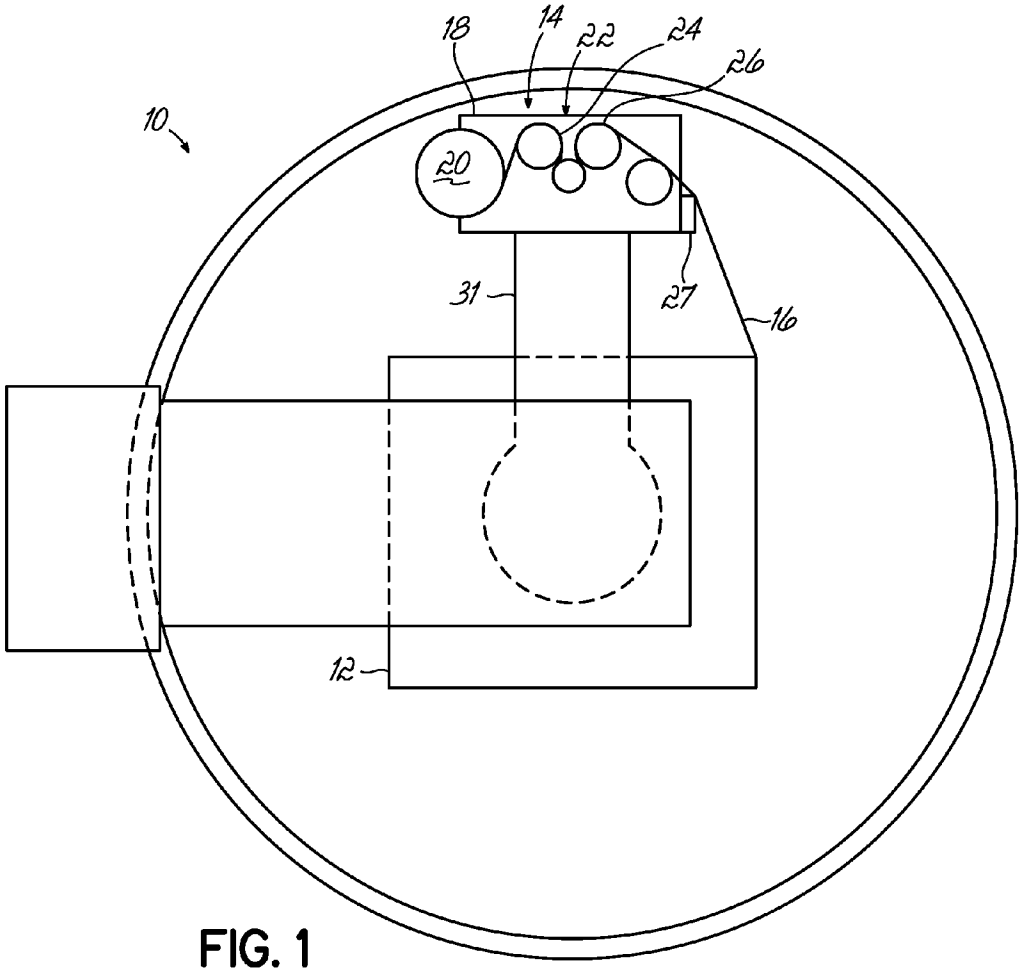
FIG. 1 is a schematic illustration of a top view of a wrapping machine according to an aspect of the present disclosure.
Figure 2:
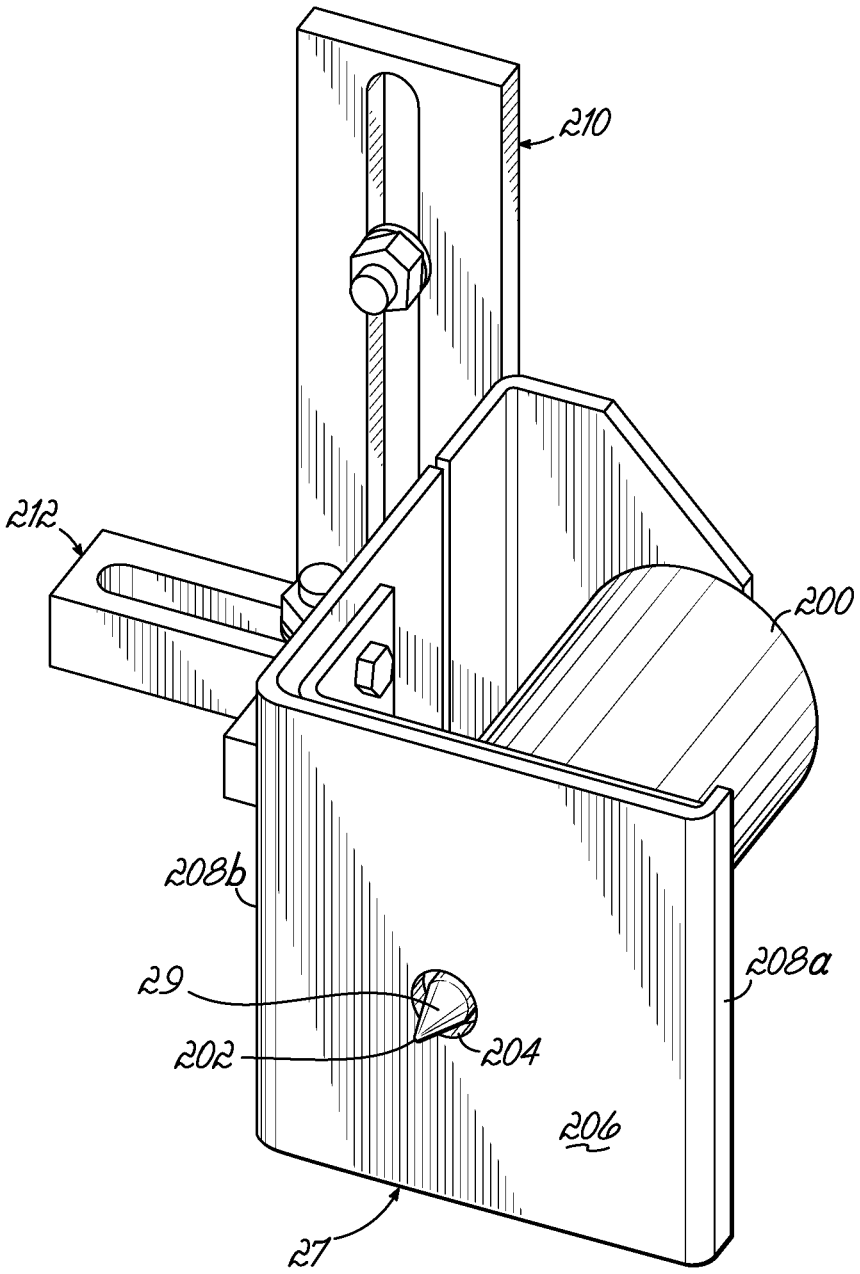
FIG. 2 is a perspective view of an exemplary wrap hazard, showing a punch in an extended position according to an aspect of the present disclosure.
Figure 3:
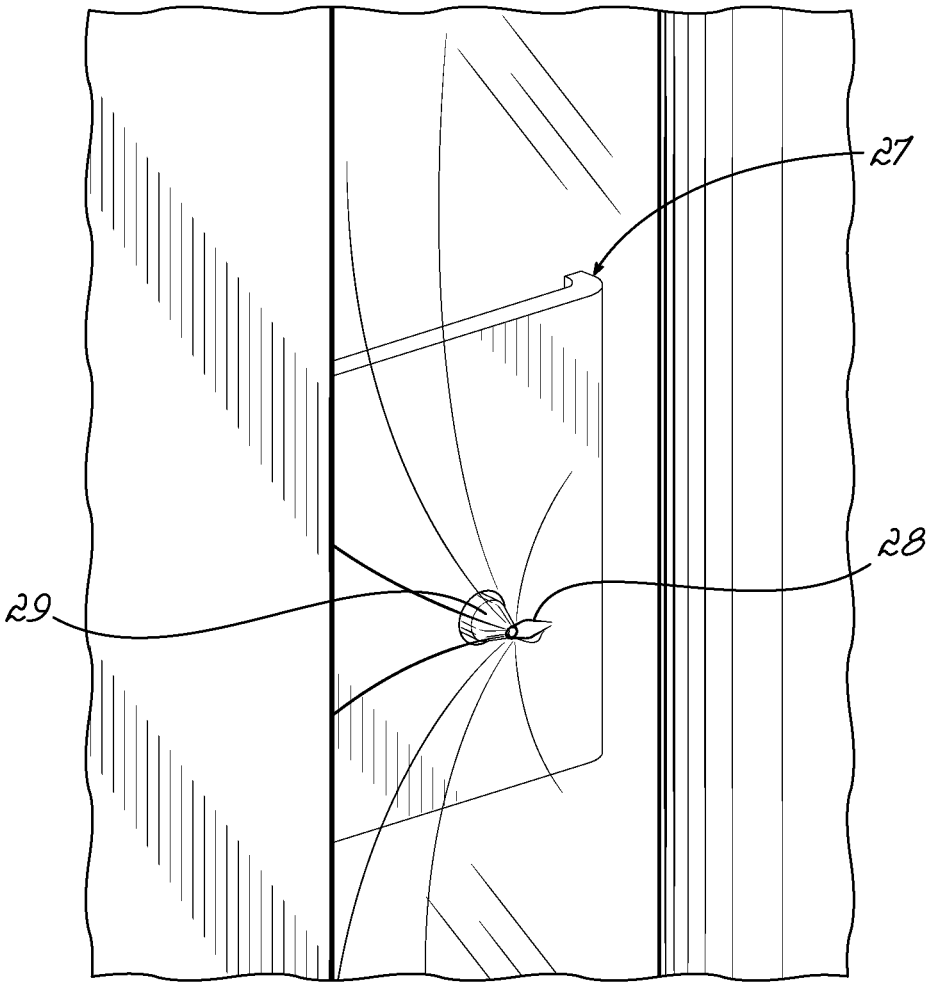
FIG. 3 is a partial perspective view of a wrapping machine with the wrap hazard of FIG. 2 and depicting the punch engaging packaging material according to an aspect of the present disclosure.
Figure 4:
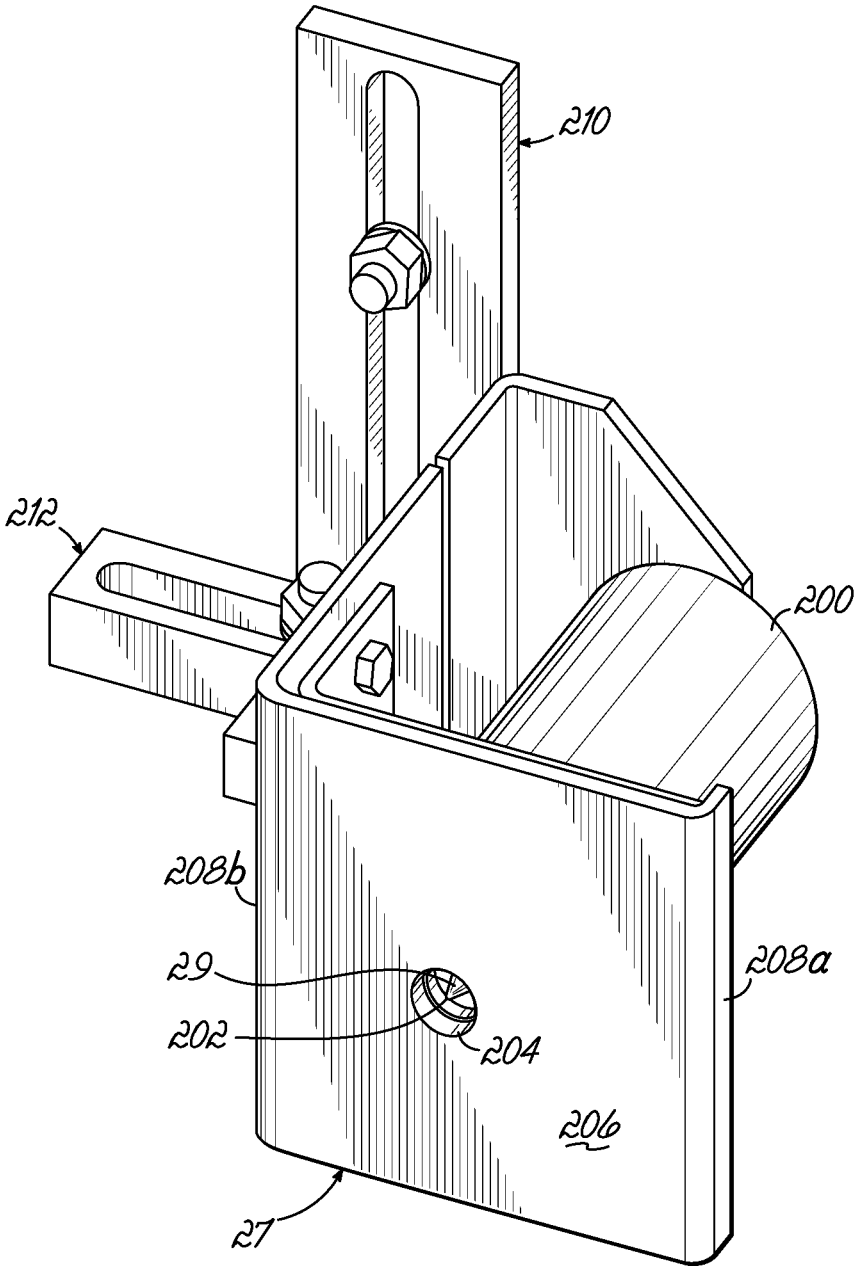
FIG. 4 is perspective view of the wrap hazard of FIG. 2, depicting the punch in a retracted position according to an aspect of the present disclosure.

According to one aspect of this disclosure, a wrapping machine 10 for wrapping a load 12, is shown in FIG. 1. The wrapping machine 10 includes a packaging material dispenser 14 for dispensing packaging material 16. The packaging material dispenser 14 includes a roll carriage 18 configured to support a roll 20 of the packaging material 16. The packaging material 16 may include stretch wrap packaging material. Stretch wrap packaging material has a high yield coefficient to allow the material to undergo stretching during wrapping. Alternatively, the packaging material 16 may include netting, strapping, banding, or tape. When another packaging material is to be used or evaluated, the roll 20 may be replaced with a roll of the other packaging material.

The packaging material dispenser 14 also includes one or more packaging material dispensing rollers 22 configured to receive packaging material 16 from the roll 20 and dispense the packaging material 16 for application to the load 12. The one or more packaging material dispensing rollers 22 may include prestretch rollers 24 and 26. The prestretch rollers 24 and 26 are configured to stretch the packaging material 16 before the packaging material 16 is dispensed to the load 12. The prestretch rollers 24 and 26 stretch the packaging material 16 by engaging a portion of the packaging material 16 with the upstream prestretch roller 24, which rotates at a slower speed than the downstream prestretch roller 26, while also engaging a portion of the packaging material 16 with the downstream prestretch roller 26. The disparity between the rotational speeds of the prestretch rollers 24 and 26 cause stretching of the portion of the packaging material 16 between the prestretch rollers 24 and 26.

The wrapping machine 10 may also include a controller (not shown) configured to control a dispensing roller drive (not shown), a relative rotation drive (not shown) for driving relative rotation between the packaging material dispenser 14 and the load 12, and a vertical drive (not shown) for driving relative vertical movement between the packaging material dispenser 14 and the load 12. It is contemplated that the drives may include one or more electric motors or any other suitable drive devices, similar to what is described in U.S. Patent Application Publication No. 2009/0178374.

The wrapping machine 10 may also include a rotating arm 31, a rotatable turntable (not shown), or a rotating ring (not shown), driven by the relative rotation drive, as described in U.S. Patent Application Publication No. 2009/0178374.

Figure 5:
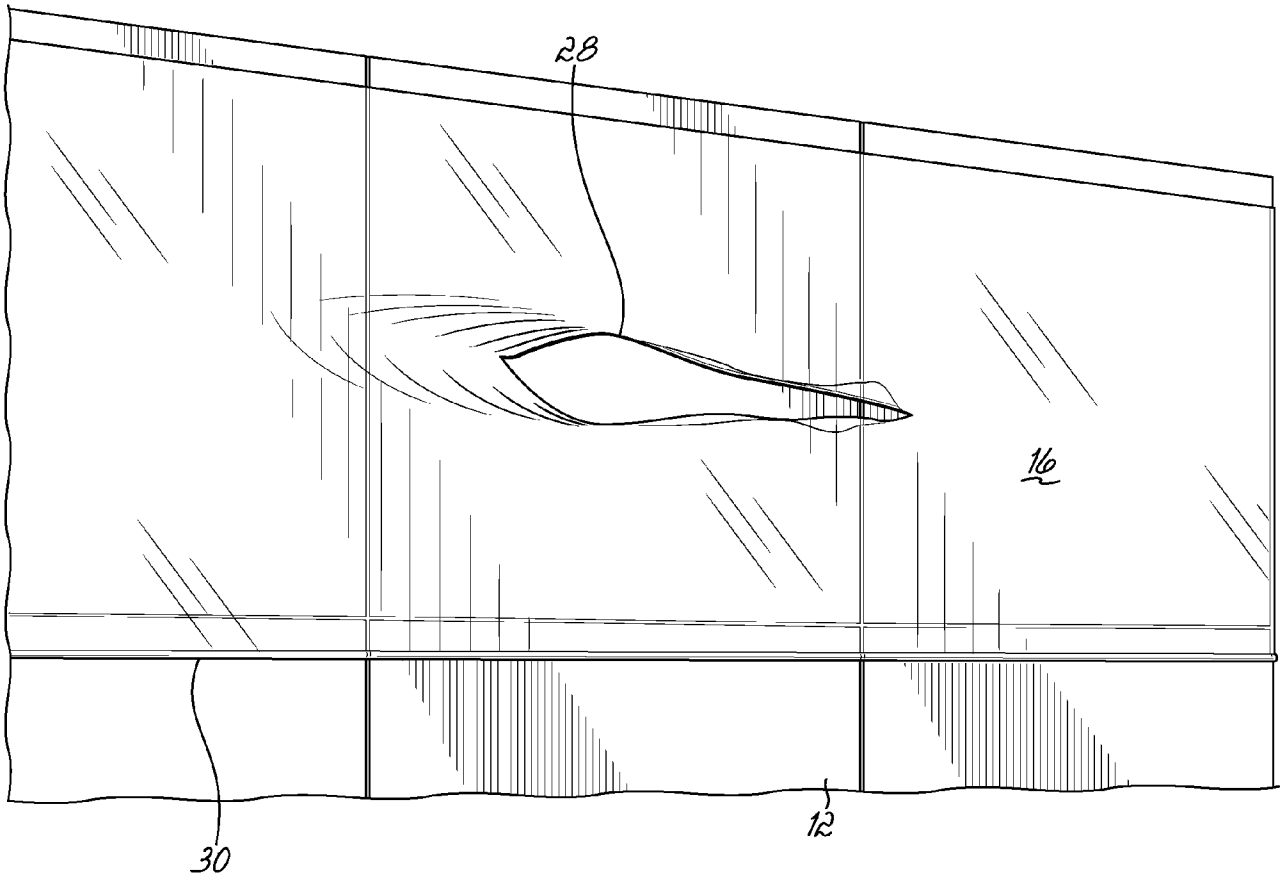
FIG. 5 is an elevation view of a length of packaging material on a load, wherein the packaging material includes a tear that is beginning to zip, split, extend, and/or otherwise propagate, according to an aspect of the present disclosure.

As a tool to assist with evaluating packaging materials, the wrapping machine 10 may include a wrap hazard 27, shown in FIGS. 1-4. It is contemplated that the wrapping machine 10 may be a production machine on which the wrap hazard 27 is attached in order for the wrapping machine 10 to be used to evaluate packaging materials. The wrap hazard 27 simulates or approximates conditions that can cause breaks in packaging materials during wrapping. In the exemplary embodiment shown, the standardized wrap hazard 27 may include a punch 29 that can be mounted, for example, on the packaging material dispenser 14. The punch 29 may be controlled by an actuator 200, such as a solenoid, a piston, or any other suitable actuator. The punch 29 moves between an extended state (shown in FIGS. 2 and 3) and a retracted state (shown in FIG. 4). In the extended state, at least a portion of the punch 29 extends into a path of moving packaging material 16 as it travels to the load 12, in order to damage (e.g., puncture and/or rip) the moving packaging material 16. The punch 29 remains in the extended state for a selected period of time, and thus, due to relative movement between the packaging material 16 and the punch 29, the punch 29 produces a lengthwise tear 28 in the packaging material 16, as shown in FIG. 5, for example.

In the embodiment shown, the punch 29 comprises an elongate member having a relatively sharp, conically-shaped tip 202 for puncturing the packaging material 16. The tip 202 is extended through an aperture 204 in a guide plate 206 when the punch 29 is moved to the extended state into the path of the packaging material 16. Leading and trailing edges 208*a*, 208*b* of the guide plate 206 may be radiused to provide smooth engagement with the packaging material 16 so that the packaging material 16 is able to glide easily over the guide plate 206 when the punch 29 is in the retracted state. The wrap hazard 27 may be mounted on a packaging material dispenser 14 by one or more brackets, such as brackets 210, 212 configured to provide location adjustability of the punch 29 and guide plate 206 relative to the path of the moving packaging material 16.

While the wrap hazard 27 has been shown and described herein as including a punch 29 having a relatively sharp, conically-shaped tip 202, it will be appreciated that the punch 29 may comprise various other structure suitable for puncturing and/or ripping packaging material 16. Moreover, it will be appreciated that the wrap hazard 27 may alternatively comprise various other structure suitable for causing intentional damage to the packaging material 16 for purposes such as those described herein.

Testing has shown that desirable results were achieved with the punch extended for approximately 100 milliseconds on a wrapping machine having a rate of relative rotation between a packaging material dispenser and a load of approximately thirty-five revolutions per minute. It should be understood, however, that the selected time at which the punch 29 remains extended may be longer where the revolution rate is less, and shorter when the revolution rate is greater. In the retracted state (FIG. 4), the punch 29 is out of contact with the packaging material 16. By controlling actuation of the punch 29, tearing of the packaging material 16 can be standardized from one wrap cycle to the next. This consistency helps with the evaluation process by removing a potential source of variability.

The punch 29 may be used by a machine operator to collect one or more data collection points. The one or more data collection points may include, for example, one or more values of a wrap force exerted on the packaging material between the dispenser and the load wherein certain behaviors are exhibited by the torn packaging material. When the wrapping machine is configured to selectively meter a desired amount of film dispensed to the load, then wrap force is related to payout percentage, and the data collection points may therefore include one or more payout percentage values at which certain behaviors are exhibited by the torn packaging material. A payout percentage may be defined as a measure of a length of packaging material dispensed during one relative revolution between a packaging material dispenser and a load, divided by a girth of the load.

Figure 6:
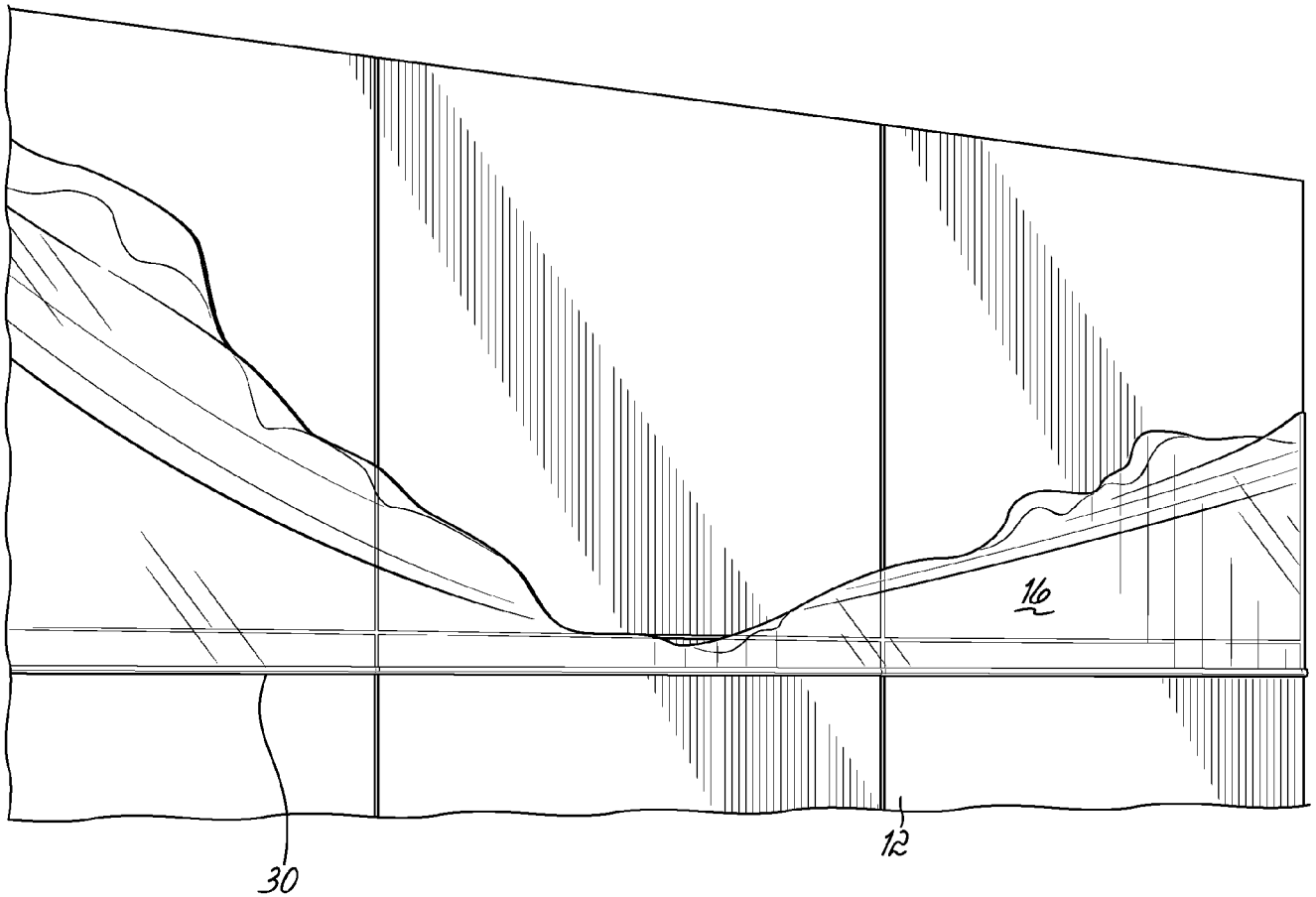
FIG. 6 is an elevation view of a length of packaging material on a load wherein the packaging material includes a tear that has propagated to a rope or rolled cable, according to an aspect of the present disclosure.
Figure 7:
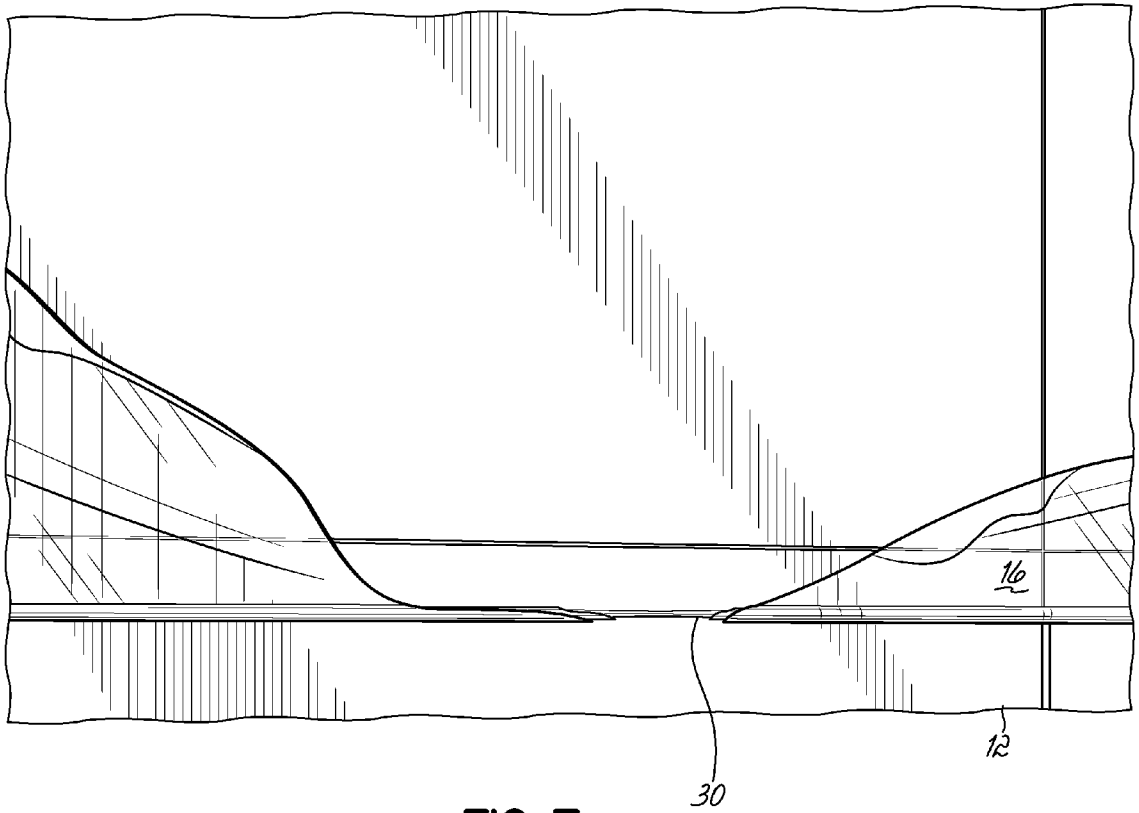
FIG. 7 is an elevation view of a length of packaging material on a load wherein the packaging material includes a tear that has propagated to a rope, with the rope beginning to stretch toward breaking, according to an aspect of the present disclosure.

When the wrapping machine is configured to selectively meter a desired amount of film dispensed to the load, the one or more data collection points may include a first data collection point indicative of a first payout percentage where the tear 28 produced by the punch 29 begins to propagate (as depicted in FIG. 5); a second data collection point indicative of a second payout percentage where the tear produced by the punch 29 propagates to a rope or rolled cable 30 formed from an edge portion of the packaging material 16 (as depicted in FIG. 6); and a third data collection point at a third payout percentage where the tear produced by the punch 29 has propagated to the rope or rolled cable 30 and the rope or rolled cable 30 stretches toward breaking (as depicted in FIG. 7). The packaging material 16 and its rope or rolled cable 30 may be similar to that described in U.S. Patent Application Publication No. 2007/0204565, U.S. Patent Application No. 2007/0209324, U.S. Pat. No. 7,568,327, and/or U.S. Pat. No. 7,779,607, and the rope or rolled cable 30 may be formed during wrapping in the manner described in any of the above-referenced applications and patents.

When a wrapping machine is not configured to selectively meter a desired amount of film dispensed to the load, then the data collection points described above are noted for values of a wrap force, or alternatively wrap settings, wherein the torn film exhibits the behaviors described above. For the purposes of this disclosure, wrap force can be defined as the force exerted on the packaging material between the dispenser and the load being wrapped. The wrap force, as so defined, will be substantially equal to the initial amount of force exerted on the load by a layer of packaging material wrapped around the load, though this value can decay over time. The total amount of force exerted on the wrapped load by all of the layers of the packaging material is defined herein as the containment force.

According to an aspect of this disclosure, a packaging material evaluation method performed with the wrapping machine 10 is provided. The method may include the following steps:

(1) A packaging material to be evaluated, such as the packaging material 16, is loaded into the packaging material dispenser 14.

(2) Information identifying the packaging material 16 may be entered into a spreadsheet, table, or chart 32 shown in FIGS. 8A-8D, such as in cells 34 and 36 in FIG. 8A, along with the date of testing in a cell 37. The spreadsheet 32 may be stored on any suitable computer or computing device (e.g., processor, personal computer, laptop, or smartphone) that may either be part of the wrapping machine 10 or remote from the wrapping machine 10. FIGS. 8A-8D show different portions of the spreadsheet 32, and it should be understood that those parts may be lined up side-by-side to form one large spreadsheet.

(3) By programming the controller (not shown) using any suitable data entry tool (e.g., a keypad, a keyboard, and/or a touchscreen), wrap settings may be established. For example, the relative rotation drive (not shown) may be set to provide relative rotation between the packaging material dispenser 14 and the load 12, which may be a test load (e.g., a forty-five inch by forty-five inch plywood box, a load mimicking a production load, or an actual production load), at a selected revolution speed. The revolution speed selected may be, for example, a maximum speed of the relative rotation drive. Additionally, the payout percentage may be selected.

(4) A wrap cycle is performed at the selected payout percentage.

(5) During the wrap cycle, an edge portion of the packaging material 16 may be formed into the rope or rolled cable 30 by a drive down and roping assembly (not shown) similar to that described in U.S. Patent Application Publication No. 2007/0209324 and/or U.S. Pat. No. 7,568,327.

(6) During the wrap cycle, the punch 29 is extended to form the tear 28 in the dispensed packaging material 16. That is, the punch 29 is extended to impinge the packaging material path for the selected time period (e.g., 100 milliseconds) before being retracted out of the path. During this time, the punch 29 forms the tear 28 in the packaging material 16. It is contemplated that the punch 29 may be timed such that the portion of the packaging material 16 with the tear 28 applied over the same face of the load 12 each time, so an observer can see the tear 28 without having to move around the wrapping machine 10.

(7) The behavior of the tear 28 is observed to determine if the payout percentage is at a value such that the tear 28 in the packaging material begins to propagate as shown in FIG. 5. If the tear 28 does not propagate, this indicates that the payout percentage is too high. If the tear 28 propagates to the rope or rolled cable 30 (as shown in FIG. 6) or if the rope or rolled cable 30 begins to stretch or break (as shown in FIG. 7), this indicates that the payout percentage is too low.

(8) If necessary, additional wrap cycles are performed at incrementally higher or lower payout percentage levels (depending on the behavior of the packaging material 16) to find the first payout percentage, i.e., the payout percentage where the tear begins to propagate. When wrapping production loads at the first payout percentage, a tear in the packaging material 16 most likely will not cause the packaging material 16 to break. It should be understood that between these wrap cycles, the packaging material 16 on the load 12 may be removed so that it does not affect the behavior of the packaging material 16 during the next wrap cycle.

(9) The spreadsheet 32 is updated to include the first payout percentage in a cell 38.

(10) One or more wrap cycles are performed, with the punch 29 extending during each wrap cycle to tear the packaging material 16, at incrementally lower payout percentages, until the second payout percentage is found, i.e., the payout percentage at which the tear 28 propagates cleanly to the rope or rolled cable 30 (as shown in FIG. 6). Without the rope or rolled cable 30 present, the tear would most likely break the packaging material 16 when wrapping at the second payout percentage. It should be understood that the iterative process of identifying the second payout percentage may be similar to the process used to identify the first payout percentage.

(11) The spreadsheet 32 is updated to include the second payout percentage in a cell 40.

(12) One or more wrap cycles are performed, with the punch 29 extending during each wrap cycle to tear the packaging material 16, at incrementally lower payout percentages, until the third payout percentage is found, i.e., the payout percentage at which the tear 28 propagates cleanly to the rope or rolled cable 30 and the rope or rolled cable 30 begins to stretch toward breaking (shown in FIG. 7). It should be understood that the iterative process of identifying the third payout percentage may be similar to the process used to identify the first and second payout percentages.

(13) The spreadsheet 32 is updated to include the third payout percentage in a cell 42.

(13.1) A wrap cycle is performed at a payout percentage of 105% having a wrapping pattern where three wraps of the packaging material 16 are applied to a top of the load 12, and nine wraps total are applied to the load 12 as a whole.

(13.2) A containment force exerted on the load 12 by the three top wraps is measured using, for example, the containment force measuring device of U.S. Pat. No. 7,707,901.

(13.3) The containment force is entered into the spreadsheet 32 at a cell 43. This value is used for comparison and reference purposes.

(14) A wrap cycle is performed at the second payout percentage, with a wrapping pattern where three wraps of the packaging material 16 are applied to a top of the load 12, and nine wraps total are applied to the load 12 as a whole.

(15) A first containment force exerted on the load 12 by the three top wraps is measured using, for example, the containment force measuring device of U.S. Pat. No. 7,707,901.

(16) The first containment force is entered into the spreadsheet 32 at a cell 44.

(17) The first containment force is divided by the number of wraps producing the first containment force (three wraps in this example) to determine a first wrap force indicative of the portion of the first containment force exerted by each of the wraps.

(18) The first wrap force is entered into the spreadsheet 32 at a cell 46.

(19) A first weight is determined by cutting the packaging material 16 from the load 12 and weighing the packaging material 16.

(20) The first weight is entered into the spreadsheet 32 at a cell 48.

(21) The first weight is divided by the number of wraps used to wrap the load 12 (nine wraps in this example) to determine a first weight per revolution indicative of the weight of the packaging material 16 dispensed during each relative revolution between the packaging material dispenser 14 and the load 12.

(22) The first weight per revolution is entered into the spreadsheet at a cell 50.

(23) Steps 14-22 are repeated, with results, including a second containment force, a second wrap force, a second weight, and a second weight per revolution, being entered into the spreadsheet at cells 52, 54, 56, and 58.

(24) A first intermediate payout percentage between the first payout percentage and the second payout percentage is calculated. For example, the first intermediate payout percentage may be an average of the first and second payout percentages. Wrapping at lower payout percentages can be beneficial in that it increases the containment force exerted by a packaging material on a load, but can also be detrimental in that it increases the risk of breaking the packaging material during wrapping. The first payout percentage is high enough that the risk of breaking the packaging material is significantly reduced regardless of whether the packaging material has the rope or rolled cable 30, since tears in the packaging material just barely begin to propagate at the first payout percentage. However, the first payout percentage also produces less containment force on the load than, for example, the second payout percentage. The second payout percentage is low enough that the containment force on the load is higher than that generated by wrapping at the first payout percentage, but may also be so low as to increase the risk of breaking the packaging material when wrapping with packaging material that does not have the rope or rolled cable 30, since tears in the packaging material propagate cleanly through the packaging material 16 until being stopped by the rope or rolled cable 30 when wrapping at the second payout percentage. Thus, the first intermediate payout percentage strikes a balance between containment force considerations and breakage considerations for wrapping with packaging material that does not have the rope or rolled cable 30.

(25) The first intermediate payout percentage is entered into the spreadsheet at a cell 60.

(26) A second intermediate payout percentage between the second payout percentage and the third payout percentage is calculated. For example, the second intermediate payout percentage may be an average of the second and third payout percentages. The second payout percentage is high enough that the risk of breaking packaging material that has a rope or rolled cable 30 is significantly reduced, since tears in the packaging material are stopped by the rope or rolled cable 30 at the second payout percentage. However, the second payout percentage also produces less containment force on the load than, for example, the third payout percentage. The third payout percentage is low enough that the containment force on the load is higher than that generated by wrapping at the second payout percentage, but may also be so low as to increase the risk of breaking the packaging material even when wrapping with packaging material that has the rope or rolled cable 30, since the rope or rolled cable 30 starts to stretch and break when wrapping at the third payout percentage. Thus, the second intermediate payout percentage strikes a balance between containment force considerations and breakage considerations for wrapping with packaging material that has the rope or rolled cable 30.

(27) The second intermediate payout percentage is entered into the spreadsheet at a cell 62.

(28) Steps 14-21 are repeated, but this time using the first intermediate payout percentage to wrap the load 12.

(29) From step 28, a third containment force, a third wrap force, a third weight, and a third weight per revolution are determined and entered into the spreadsheet at cells 64, 66, 68, and 70.

(30) Steps 14-21 are repeated, but this time using the second intermediate payout percentage to wrap the load 12.

(31) From step 30, a fourth containment force, a fourth wrap force, a fourth weight, and a fourth weight per revolution are determined and entered into the spreadsheet at cells 72, 74, 76 and 78.

(32) A desired containment force for wrapping loads is determined by performing one or more trial runs where a wrapped load is shipped, and after shipping, is evaluated to determine if it has remained sufficiently intact after experiencing the forces and stresses associated with shipping. The containment force exerted on the wrapped load by the packaging material is measured using, for example, a containment force measuring device (not shown) like the one described in U.S. Pat. No. 7,707,901.

(33) The desired containment force from (step 32) is entered into the spreadsheet at cell 80.

(34) The height of the load 12 may be determined by, for example, measuring the height of the load 12 manually or by using a sensor or detector.

(35) The height of the load 12 (from step 34) is entered into the spreadsheet at cell 82.

(36) The height of the load 12 is divided by the effective height of the packaging material 16. The effective height of the packaging material 16 is its height when dispensed from the packaging material dispenser 14 as measured from a first edge of the dispensed packaging material 16 to a second edge of the dispensed packaging material 16, the second edge being opposite the first edge. The first edge and the second edge may be defined by portions of the packaging material 16 that are not roped or rolled into a cable. It is also contemplated that at least one of the first edge and the second edge may be an edge portion of the rope or rolled cable 30 formed from a portion of the packaging material 16.

(37) The value obtained in step 36 is multiplied by the desired containment force (from step 32). This step is carried out because the user typically finds the desired containment force at one location on a wrapped load, while the containment force exists all around the load. By multiplying the desired containment force by the value obtained in step 36, the total containment force exerted on an entire face of the load 12 can be determined. The total containment force is entered in a cell 81 of the spreadsheet 32.

(38) The total containment force is divided by the first wrap force (from step 18) to determine a first estimated number of relative revolutions between the packaging material dispenser 14 and the load 12 for achieving the desired containment force from step 32 when wrapping with the packaging material 16.

(39) The first estimated number of relative revolutions (from step 38) is entered into the spreadsheet 32 at a cell 84.

(40) The first estimated number of relative revolutions (from step 38) is multiplied by the first weight per revolution (from step 22) to determine a first estimated weight of the packaging material 16 needed to wrap the load 12 with the desired containment force from step 32.

(41) The first estimated weight (from step 40) is entered into the spreadsheet at a cell 86.

(42) The total containment force is divided by the second wrap force (from step 23) to determine a second estimated number of relative revolutions between the packaging material dispenser 14 and the load 12 for achieving the desired containment force from step 32 when wrapping with the packaging material 16.

(43) The second estimated number of relative revolutions (from step 42) is entered into the spreadsheet 32 at a cell 88.

(44) The second estimated number of relative revolutions (from step 42) is multiplied by the second weight per revolution (from step 23) to determine a second estimated weight of the packaging material 16 needed to wrap the load 12 with the desired containment force from step 32.

(45) The second estimated weight (of step 44) is entered into the spreadsheet 32 at a cell 90.

(46) The total containment force is divided by the third wrap force (from step 29) to determine a third estimated number of relative revolutions between the packaging material dispenser 14 and the load 12 for achieving the desired containment force from step 32 when wrapping with packaging material that does not have a roped or rolled portion, avoiding an undesirable amount of breaks in the packaging material 16 during wrapping, and doing all this at or close to a minimum cost to the user.

(47) The third estimated number of relative revolutions (from step 46) is entered into the spreadsheet 32 at a cell 92.

(48) The third estimated number of relative revolutions (from step 46) is multiplied by the third weight per revolution (from step 29) to determine a third estimated weight of the packaging material 16 needed to wrap the load 12 with the desired containment force from step 32 when wrapping with packaging material that does not have a rope or rolled cable 30, while avoiding an undesirable amount of breaks in the packaging material 16 during wrapping, and doing all this at or close to a minimum cost to the user.

(49) The third estimated weight (of step 48) is entered into the spreadsheet 32 at a cell 94.

(50) The total containment force is divided by the fourth wrap force (from step 31) to determine a fourth estimated number of relative revolutions between the packaging material dispenser 14 and the load 12 for achieving the desired containment force from step 32 when wrapping with packaging material that has a rope or rolled cable 30, avoiding an undesirable amount of breaks in the packaging material 16 during wrapping, and doing all this at or close to a minimum cost to the user.

(51) The fourth estimated number of relative revolutions (from step 50) is entered into the spreadsheet 32 at a cell 96.

(52) The fourth estimated number of relative revolutions (from step 50) is multiplied by the fourth weight per revolution (from step 31) to determine a fourth estimated weight of the packaging material 16 needed to wrap the load 12 with the desired containment force from step 32 when wrapping with packaging material that has a rope or rolled cable 30, while avoiding an undesirable amount of breaks in the packaging material 16 during wrapping, and doing all this at or close to a minimum cost to the user.

(53) The fourth estimated weight (of step 52) is entered into the spreadsheet 32 at a cell 98.

(54) Field data including, for example, a user's estimates of the number of revolutions required and weight of packaging material required, for wrapping with and without the rope or rolled cable 30, can be entered into the cells 126, 128, 130, and 132, for comparing with the estimates in the other cells of the spreadsheet 32.

(55) The above-outlined steps may be repeated for different packaging materials, with calculated or determined values associated with those packaging materials appearing in another row of cells 100.

(56) The spreadsheet 32 may be updated if, for example, the dimensions (e.g., height and/or girth) of the user's load changes, or if the effective height of the user's packaging material changes. Thus, the spreadsheet 32 may be tailored to the user's particular wrapping conditions.

Figure 9:
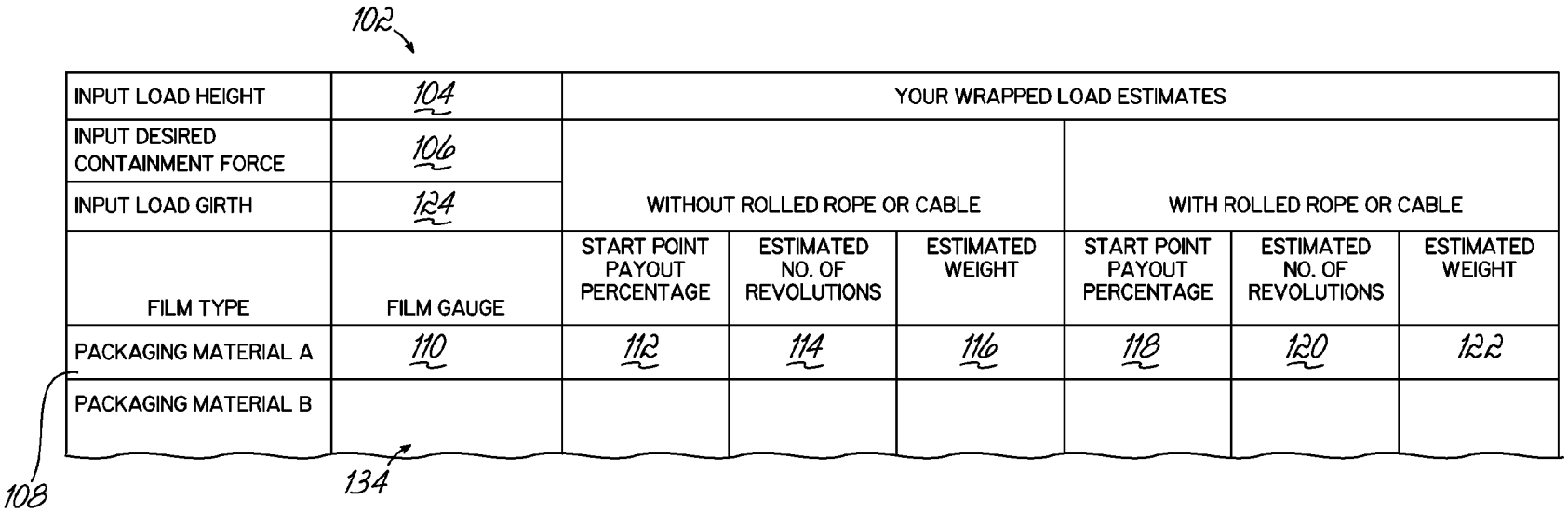
FIG. 9 depicts a portion of a spreadsheet, table, or chart, according to an aspect of the present disclosure.

(57) Data from the spreadsheet 32 may be imported into a spreadsheet, table, or chart 102, shown in FIG. 9. For example, data from cells 82, 80, 34, 36, 60, 92, 94, 62, 96, and 98 in the spreadsheet 32 may appear in cells 104, 106, 108, 110, 112, 114, 116, 118, 120, and 122 in the spreadsheet 102. Similarly, data from the row of cells 100 in the spreadsheet 32 may appear in a row of cells 134 in the spreadsheet 102, and so on.

(58) A girth of a user's production load may be entered in a cell 124 of the spreadsheet 102.

(59) The spreadsheet 102 may be provided electronically and/or in a report format to the user and/or any other machine operator.

It is contemplated that by using the spreadsheet 102, a start-up technician sent to set up the wrapping machine 10 at a user's site may set parameters for wrapping including the payout percentage, the number of relative revolutions between the packaging material dispenser 14 and the load 12 during a wrapping cycle, and other known wrap settings, based on the data from the spreadsheet 102, to achieve a desired containment force while ensuring that wrapping will be performed without an undesirable amount of breaks in the user's packaging material, and at or close to a minimum cost to the user. For example, the start-up technician may identify the packaging material used by the user, find the packaging material on the spreadsheet 102, determine whether the user is wrapping with or without a rope or rolled cable, and select the appropriate payout percentage and number of relative revolutions for the packaging material dispenser based on that information. The startup technician may also be able to provide the user with an estimate on the weight of the packaging material required to wrap each of the user's loads.

Additionally or alternatively, the user may use the spreadsheet 102 to personally set up the wrapping machine 10 and achieve similar benefits. Thus, the user will be able to see the full potential and advantages of using the wrapping machine 10, which may not be as clearly evident if the user uses incorrect settings to wrap the loads.

It is also contemplated that the data on the spreadsheet 102 may help the user select from different packaging materials, since the spreadsheet 102 provides the user with a way to compare different packaging materials. For example, by viewing the spreadsheet 102, the user may determine that wrapping with a first packaging material requires more packaging material by weight than wrapping with a second type of packaging material. With a simple calculation, the user can determine which of the two packaging materials is more cost-effective. Additionally or alternatively, a start-up technician or any other machine operator may use the spreadsheet 102 to help the user select from different packaging materials or make recommendations to the user.

Further, it is contemplated that the spreadsheet 102 may be utilized to help manufacturers of packaging materials improve their products, since the spreadsheet 102 provides a way to evaluate one type of packaging material against many others.

It should be understood that the values calculated or determined in the above-outlined steps may be calculated and determined automatically by the spreadsheet 102, which may be running on any suitable computing device (not shown), when data used to calculate or determine the values is available to the spreadsheet, whether the data is input into the spreadsheet by a user or received from another source, such as another computing device, one or more sensing assemblies, and/or any other system suitable for collecting and/or transmitting data.

It should also be understood that one or more of the values calculated or determined in the above-outlined steps may be rounded (i.e., replaced by another value that is approximately equal but has a shorter, simpler, or more explicit representation) or calculated or determined using rounded input values. Additionally or alternatively, any of the above-described values may be adjusted for efficiency or another suitable reason. Thus, for the purposes of this application, a value A should be understood to include not only the actual value A, but also any rounded or adjusted values based on or indicative of the value A.

Other embodiments of the present disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for determining a wrap force at which to wrap a load with packaging material, the method comprising:

dispensing packaging material to a load;

intentionally forming a tear in a portion of the packaging material;

identifying a first wrap force at which the tear exhibits a first behavior;

identifying a second wrap force at which the tear exhibits a second behavior; and selecting a first intermediate wrap force between the first wrap force and the second wrap force, for wrapping the load.

2. The method of claim 1, wherein forming a tear in a portion of the packaging material includes extending a punch into a path of the dispensed packaging material.

3. The method of claim 1, wherein identifying a first wrap force at which the tear exhibits a first behavior includes performing one or more wrap cycles, each at a different wrap force, until the first behavior is exhibited.

4. The method of claim 1, wherein identifying a second wrap force at which the tear exhibits a second behavior includes performing one or more wrap cycles, each at a different wrap force, until the second behavior is exhibited.

5. The method of claim 1, wherein selecting a first intermediate wrap force includes averaging the first wrap force and the second wrap force.

6. The method of claim 1, wherein the first behavior is the beginning of the propagation of the tear in the packaging material.

7. The method of claim 1, wherein the second behavior is the propagation of the tear to a rope or rolled cable of the packaging material.

8. The method of claim 1, further comprising:

identifying a third wrap force at which the tear exhibits a third behavior; and selecting a second intermediate wrap force between the second wrap force and the third wrap force.

9. The method of claim 8, wherein the third behavior is the propagation of the tear to a rope or rolled cable of the packaging material, and the beginning of stretching of the rope or rolled cable.

10. A method for determining a payout percentage at which to wrap a load with packaging material, the method comprising:

dispensing packaging material to a load;

intentionally forming a tear in a portion of the packaging material;

identifying a first payout percentage at which the tear exhibits a first behavior;

identifying a second payout percentage at which the tear exhibits a second behavior; and selecting a first intermediate payout percentage between the first payout percentage and the second payout percentage, for wrapping the load.

11. The method of claim 10, wherein forming a tear in a portion of the packaging material includes extending a punch into a path of the dispensed packaging material.

12. The method of claim 10, wherein identifying a first payout percentage at which the tear exhibits a first behavior includes performing one or more wrap cycles, each at a different payout percentage, until the first behavior is exhibited.

13. The method of claim 10, wherein identifying a second payout percentage at which the tear exhibits a second behavior includes performing one or more wrap cycles, each at a different payout percentage, until the second behavior is exhibited.

14. The method of claim 10, wherein selecting a first intermediate payout percentage includes averaging the first payout percentage and the second payout percentage.

15. The method of claim 10, wherein the first behavior is the beginning of the propagation of the tear in the packaging material.

16. The method of claim 10, wherein the second behavior is the propagation of the tear to a rope or rolled cable of the packaging material.

17. The method of claim 10, further comprising:

identifying a third payout percentage at which the tear exhibits a third behavior; and selecting a second intermediate payout percentage between the second payout percentage and the third payout percentage.

18. The method of claim 17, wherein the third behavior is the propagation of the tear to a rope or rolled cable of the packaging material, and the beginning of stretching of the rope or rolled cable.

19. A method of determining a number of relative revolutions between a packaging material dispenser and a load for wrapping the load with a first packaging material, the method comprising:

wrapping a test load with the first packaging material at a selected wrap force setting;

determining an incremental force exerted by each wrap of the first packaging material on the test load;

determining a partial containment force for a wrapped load at a selected area of the wrapped load;

obtaining one or more characteristics of the load;

obtaining one or more characteristics of the first packaging material;

determining a total containment force for wrapping the load based on the partial containment force, the one or more characteristics of the load, and the one or more characteristics of the first packaging material; and determining the number of relative revolutions for wrapping the load based on the total containment force and the wrap force exerted by each wrap of first packaging material on the test load.

20. The method of claim 19, wherein obtaining one or more characteristics of the load includes obtaining a height of the load.

21. The method of claim 19, wherein obtaining one or more characteristics of the first packaging material includes obtaining an effective height of the first packaging material.

22. The method of claim 19, wherein determining a total containment force includes dividing a height of the load by an effective height of the first packaging material to obtain a first value.

23. The method of claim 22, wherein determining a total containment force includes multiplying the first value by the wrap force exerted by each wrap of first packaging material on the test load.

24. The method of claim 19, wherein wrapping the test load with the first packaging material at a selected wrap force setting includes wrapping the test load at a wrap force setting selected between a first wrap force setting at which a tear formed in the first packaging material exhibits a first behavior, and a second wrap force setting at which a tear formed in the first packaging material exhibits a second behavior.

25. The method of claim 24, wherein:

the first behavior is the beginning of the propagation of the tear in the first packaging material; and the second behavior is the propagation of the tear to a rope or rolled cable of the first packaging material.

26. The method of claim 19, wherein determining the number of relative revolutions for wrapping the load includes dividing the total containment force by the wrap force exerted by each wrap of the first packaging material on the test load.

27. The method of claim 19, further comprising:

determining a weight of packaging material for wrapping a load by:

determining a weight of each wrap of packaging material on the test load, and determining the weight of packaging material for wrapping the load based on the number of revolutions and the weight of each wrap of packaging material on the test load.

28. The method of claim 19, further comprising:

determining a number of relative revolutions between a packaging material dispenser and a load for wrapping the load with at least a second packaging material different from the first packaging material;

determining a weight of each of the first packaging material and the second packaging material by:

determining a weight of each wrap of packaging material on the test load, and determining the weight of packaging material for wrapping the load based on the number of revolutions and the weight of each wrap of packaging material on the test load;

obtaining cost per weight values for each of the first packaging material and the second packaging material; and determining packaging material costs for wrapping a load with each of the first packaging material and the second packaging material based on the cost per weight values and the determined weights for the first and second packaging materials.

* * * * *